United States Patent [19]

Brauchl

[11] Patent Number: 5,034,085

[45] Date of Patent: Jul. 23, 1991

[54] METHOD OF MAKING A COMPOSITE WALL STRUCTURE AND A BUILDING PREFABRICATED THEREWITH

[75] Inventor: Peter Brauchl, Baden, Austria

[73] Assignee: Brauchl-Fertighaus Vertriebsgesellschaft m.b.H. & Co. KG, Vienna, Austria

[21] Appl. No.: 117,406

[22] Filed: Oct. 29, 1987

Related U.S. Application Data

[63] Continuation of Ser. No. 858,602, May 1, 1986, abandoned.

[30] Foreign Application Priority Data

May 3, 1985 [AT] Austria ..... 1318/85
Oct. 8, 1985 [AT] Austria ..... 2896/85

[51] Int. Cl.[5] ..... B32B 31/00
[52] U.S. Cl. ..... 156/293; 52/747; 52/809; 156/70; 156/92; 428/74; 428/76

[56] References Cited

U.S. PATENT DOCUMENTS

| | | | |
|---|---|---|---|
| 1,116,045 | 11/1914 | Ellis | 52/809 |
| 1,885,607 | 11/1932 | Knox | 156/293 |
| 1,911,605 | 5/1933 | Corlette | 428/74 |
| 2,703,443 | 3/1955 | Lee | 156/293 |

*Primary Examiner*—John J. Gallagher
*Attorney, Agent, or Firm*—Herbert Dubno; Andrew Wilford

[57] ABSTRACT

Platelike or panel-shaped composite wall structure is provided by sandwiching within a frame between planking affixed to the opposite sides of the frame, an insulating body. The body is formed by depositing therein layers within the frame in the form of wood wool which is sprayed with a water glass solution. As a result a mineral-like structure of the insulation is obtained which does not tend to shift when the panel is erect. A moisture barrier which is applied in the form of a layer of bees wax can be formed directly on the planking which is to constitute the inner wall of a prefabricated structure into which a composite wall is built.

1 Claim, 2 Drawing Sheets

METHOD OF MAKING A COMPOSITE WALL STRUCTURE AND A BUILDING PREFABRICATED THEREWITH

This is a continuation of co-pending application Ser. No. 06/858,602, filed on May 1, 1986, now abandoned.

FIELD OF THE INVENTION

My present invention relates to a method of making a composite wall structure and, more particularly, to a method of making insulating composite wall structures.

BACKGROUND OF THE INVENTION

It is a common practice to prefabricate buildings for domiciles and other purposes in modular units utilizing a composite wall structure which has an insulation body therein and which comprises an impregnated wood frame or truss construction and planking on opposite sides thereof, the interior of this structure being filled with, for example, mineral wool which serves as a thermal insulating material.

In general, the rock wool or mineral fiber insulation is fitted into the wood frame in the form of a mat and serves as a thermal lagging.

In such wall constructions, efforts must be made to prevent slipping of the thermal lagging material downwardly by gravity when the wall construction is erected as a vertical wall.

Various suggestions have been made as to how this migration of the thermal insulation by gravity in prefabricated wall structures can be avoided.

One approach has been to fasten the heat insulation material in place by bars. Another approach has been to press the insulation material into the wood structure in a fashion which prevents migration.

The planking can be synthetic resin-bonded wood-particle board, plastic board or composites of other materials which generally are bonded to the synthetic resin-impregnated frame structure by adhesives and/or conventional fasteners such as screws or nails.

In all cases it is important to provide a vapor barrier or moisture barrier within the composite wall structure against the planking covering the side of the frame which is intended to be the interior wall of the structure.

Absent a vapor barrier of this type, generally when the external temperature is lower than the dew point within the interior, there is a possibility of moisture entering the composite structure or the air trapped in the composite structure condensing on the insulation material to the detriment of the insulation effect, promoting migration of the insulation material, and possibly causing rot or other damage within the construction.

Indeed, once such condensation occurs, it may lead to further penetration of the wall structure and hence further condensation to the point that the insertion may be rendered completely ineffective or the prefabricated wall panel will have to be replaced.

Wood panels of the type with which the invention is concerned, generally are used in wood houses and for high grade prefabricated modular structures, the panels being made in a factory environment to permit assembly on the building site or even shipment of completed modules to the building site.

OBJECTS OF THE INVENTION

The principal object of the present invention is to provide a method of making such panels and, more particularly, prefabricated wall structures containing insulating material, whereby the aforedescribed drawbacks are obviated.

Another object of this invention is to provide a method for the purposes described which will permit more efficient protection of the wall structure by simplification of the vapor barrier.

Another object of this invention is to provide a method of making a composite wall structure which eliminates the shifting of the thermally insulating body and the drawbacks caused thereby.

SUMMARY OF THE INVENTION

These objects and others which will become apparent hereinafter are attained, in accordance with the invention, by a method of making a composite wall structure for a building, namely, a panel which comprises the steps of:

forming a wood frames preferably a wood frame impregnated with a synthetic resin material;

affixing a rigid wall-forming planking to one side of the frame, thereby closing the frame at this side; and depositing a layer of cellulosic fiber insulation in a thickness of about 2 cm, spraying this layer with an aqueous solution of water glass (alkali silicates), applying at least one additional such layer and spraying same with the aqueous solution of water glass, with each subsequent deposited layer being similarly sprayed and then closing the opposite side of the frame with another rigid planking.

Advantageously, at least one, but preferably both, of the surfaces of the planking turned toward the insulation are also coated with the spray of water glass. In other words, after the first planking is applied, its surface turned inward is sprayed with the water glass solution and the initial insulation layer is applied. Preferably, the cellulosic material is wood wool.

The wood wool is only sprayed with water glass and is neither soaked therewith nor immersed therein.

The monolayer spray with water glass mist appears to stabilize, fix and even harden the insulation without material change in its porosity so that the insulation structure has a three-dimensional lattice configuration with a backbone formed by the sodium silicate whereby migration of the insulation is completely precluded and pockets are not formed therein. Vibration and shaking stresses do not break down the insulation materially. Combustibility is reduced.

The backbone layer of mineral formed under wood wool not only provides a satisfactory strength and stability thereto but also has an excellent effect on the thermal and acoustic insulation properties of the layer.

Advantageously, the surface of the planking adapted to form an interior wall of the building is further coated with bees wax as a vapor barrier by spraying or doctoring.

Other natural organic fibers have been found to be similarly effective and these include coconut fibers, sisal fibers, straw and seaweed.

In all cases the waterglass coating appears to provide the desired stability, insulation capacity and resistance to fire.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 2:
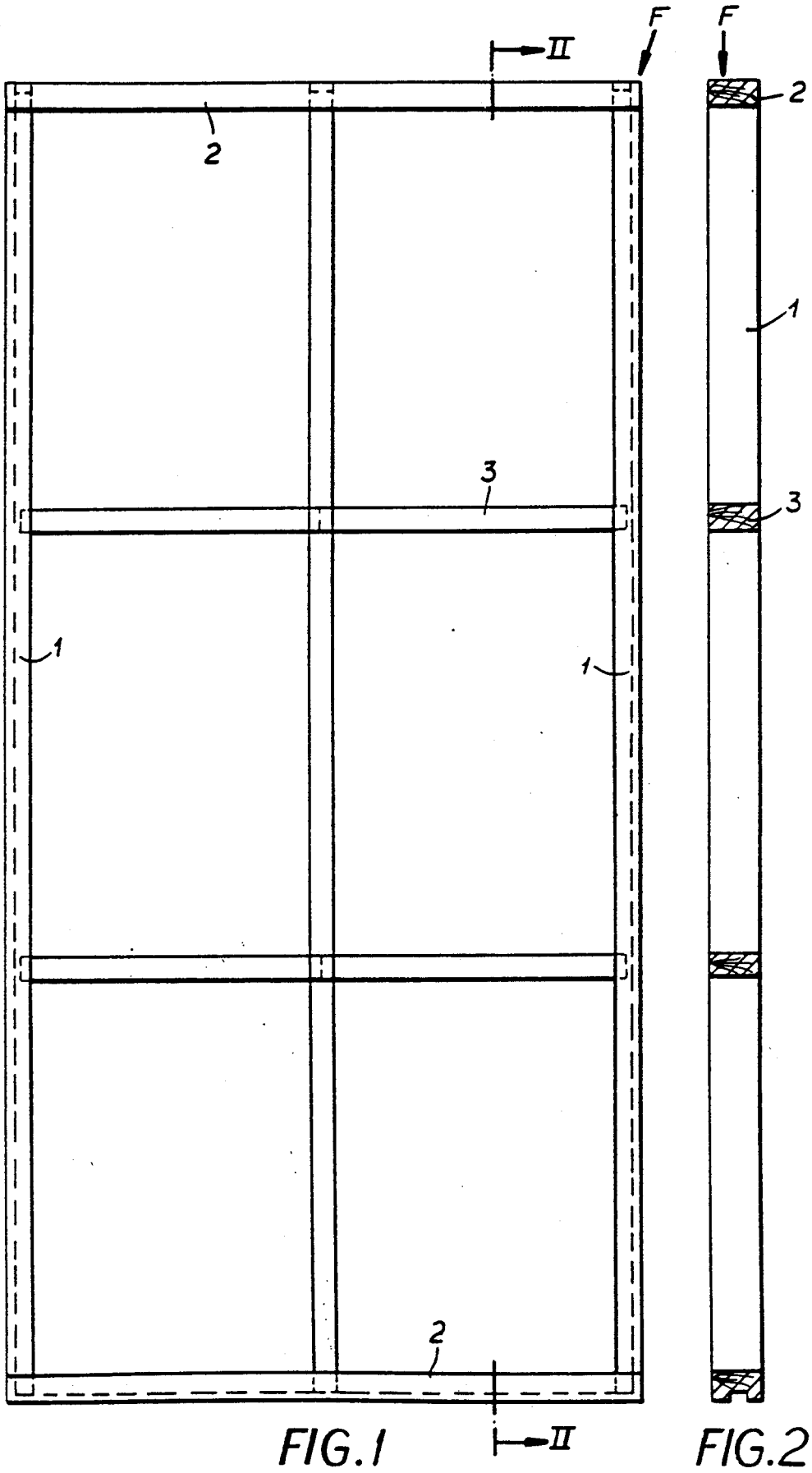
FIG. 1 is an elevational view of a frame which is provided with the cover planking and insulation body of the invention.
FIG. 2 is a cross section along the line II—II of FIG. 1.
Figure 4:
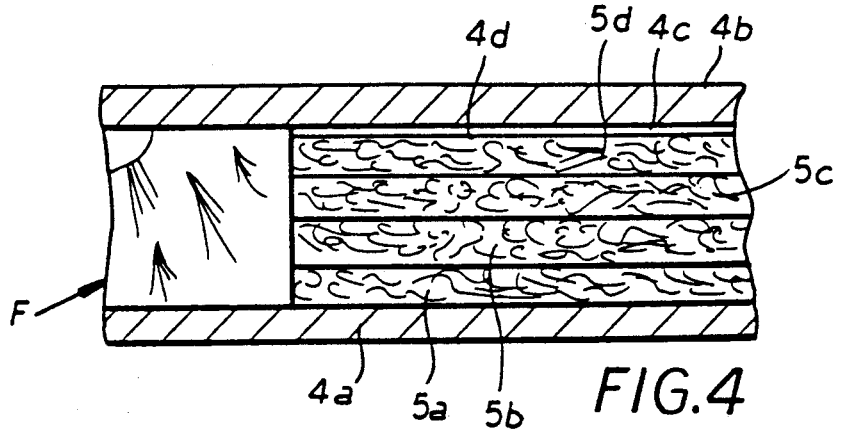
FIG. 4 is a detail cross section through this structure showing a portion of a finished panel according to the invention.

As can be seen from FIG. 1, the panel or wall structure of the invention comprises a frame F which is composed of longitudinal beams 1 and transverse beams 2 of wood which can be impregnated with synthetic resin material to reduce its flammability and even provide the desired texture and coloration. In addition, bracing members 3 of wood can be provided.

In fabricating the panel of the invention, one side of the frame F is closed by bonding a rigid planking 4*a* of plywood, synthetic resin impregnated particle board or even plaster board, to the frame, this planking being represented at 4*a*.

The frame, closed on one side, is then laid horizontally and the inner surface of the planking 4*a* is sprayed with an aqueous solution of water glass which is also sprayed onto the inner frame members.

Then layers 5*a*, 5*b*, 5*c* and 5*d* of wood wool, each layer being about 2 cm in thickness, are applied and after the application of each layer and before the application of the next, a water glass spray is applied to the layer so as to wet the surface with the spray without impregnating the layer fully.

After the application of the last layer 5*d*, interior wall paneling 4*b* is applied after it has been coated at 4*c* with bees wax to form a moisture barrier and the bees wax surface 4*d* sprayed with the water glass solution.

The planking 4*a* and 4*b* may be attached to the frame by any adhesive bonding method which is desirable but usually will also be attached by screws (not shown).

The plates 4*a* and 4*b* forming the planking can be of different thicknesses and, in the finished configuration of the wall, can be provided with paint or other finishing layers or coatings.

Figure 3:
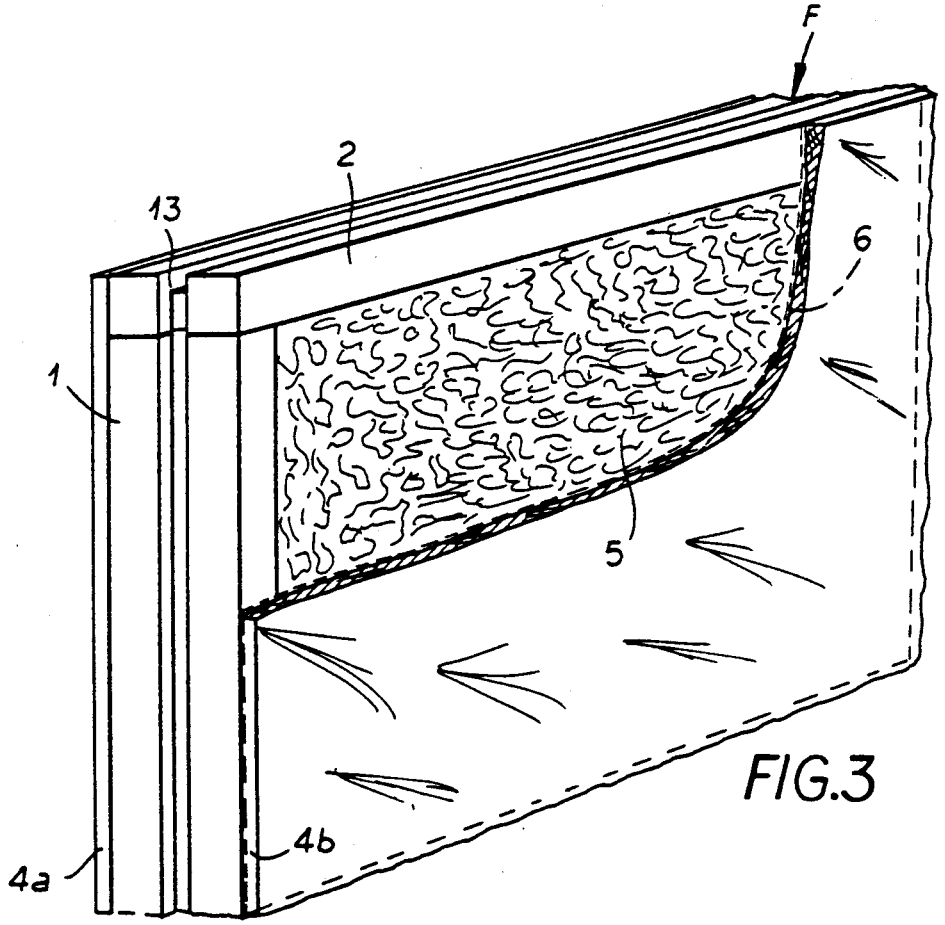
FIG. 3 is a perspective view of a corner of the finished wall structure.

The wax layer in FIG. 3 has been shown at 6 in broken lines. A wax layer can also be applied to the surfaces of the frame turned toward the body of insulation 5.

The wax can of course also be applied by spraying it onto the surface of the plate 4*a* which will then be the interior-wall plate before the insulation is applied. While preferably, the water glass film overlies the wax layer, the wax can also be applied to the water glass film on one of the plates 4*a* and 4*b*.

Figure 5:
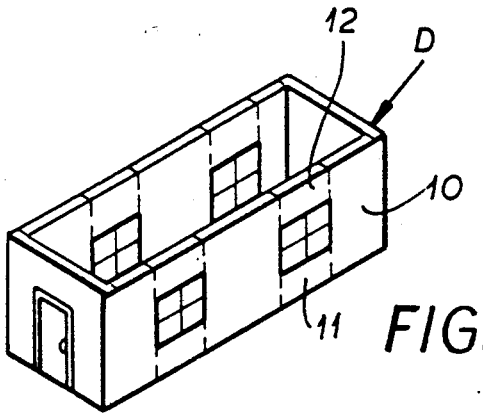
FIG. 5 is a perspective view of a modular building unit which can be prefabricated from the panels of the invention.

As can be seen in FIG. 5 a prefabricated building D has its wall formed by interconnecting panels 10, 11, 12, 13, etc., each of which is formed from a composite structure as mentioned above and which can be assembled by insulation of splines with mating grooves 13 along the edges of adjoining panels.

I claim:

1. A method of making a composite wall structure for a building, comprising the steps of:

forming a wood frame;

affixing a rigid wall-forming planking to one side of said frame, thereby closing said frame on said one side;

thereafter filling the interior of said frame with thermal insulation by depositing cellulosic fibrous insulation layers of a thickness of about 2 cm in said frame on said planking in succession directly upon one another and applying to each layer after the deposition thereof a spray of water glass, such that each layer is neither fully impregnated nor penetrated thereby, until said frame is filled with thermal insulation, and closing the opposite side of said frame by affixing a further rigid wall-forming planking to said other side of said frame, said further rigid wall-forming planking being provided on a side thereof facing said insulation with a coating of bees wax and a coating of water glass on said coating of bees wax.

* * * * *